US012653315B2

(12) United States Patent
Reinhart

(10) Patent No.: US 12,653,315 B2
(45) Date of Patent: Jun. 16, 2026

(54) BENCH WITH REMOVABLE LEG

(71) Applicant: NICKOLAS BRANDS, LLC, Findlay, OH (US)

(72) Inventor: Nickolas Reinhart, Sarasota, FL (US)

(73) Assignee: AGNA, LLC, Sarasota, FL (US)

( * ) Notice: Subject to any disclaimer, the term of this patent is extended or adjusted under 35 U.S.C. 154(b) by 237 days.

(21) Appl. No.: 18/533,312

(22) Filed: Dec. 8, 2023

(65) Prior Publication Data

US 2024/0188720 A1 Jun. 13, 2024

Related U.S. Application Data

(60) Provisional application No. 63/431,102, filed on Dec. 8, 2022.

(51) Int. Cl.

| | |
|---|---|
| ***A47C 1/14*** | (2006.01) |
| ***A47C 3/04*** | (2006.01) |
| ***A47C 4/02*** | (2006.01) |
| ***A47C 7/62*** | (2006.01) |
| ***A47C 11/00*** | (2006.01) |

(52) U.S. Cl.

CPC ..... *A47C 11/00* (2013.01); *A47C 1/14* (2013.01); *A47C 3/04* (2013.01); *A47C 4/021* (2013.01); *A47C 7/624* (2018.08)

(58) Field of Classification Search

CPC .. A47C 1/14; A47C 3/04; A47C 4/021; A47C 7/622; A47C 11/00; A47C 7/624

USPC ..... 297/188.18, 239, 440.1, 440.14

See application file for complete search history.

(56) References Cited

U.S. PATENT DOCUMENTS

| | | | | | |
|---|---|---|---|---|---|
| 2,011,067 | A | * | 8/1935 | Mckee | A47C 3/04 297/239 X |
| 3,080,194 | A | * | 3/1963 | Rowland | A47C 3/04 297/239 |
| 3,278,227 | A | * | 10/1966 | Rowland | A47C 1/124 297/239 |
| 3,404,916 | A | * | 10/1968 | Rowland | A47C 3/04 297/239 |

(Continued)

FOREIGN PATENT DOCUMENTS

| | | | | |
|---|---|---|---|---|
| CH | 718871 A2 | * | 2/2023 | A47C 7/705 |
| CN | 104433413 A | * | 3/2015 | A47C 7/00 |

(Continued)

*Primary Examiner* — Rodney B White

(74) *Attorney, Agent, or Firm* — Jacob M. Ward; Ward Law Office LLC

(57) ABSTRACT

An outdoor bench for two persons is provided that includes a seat having rear corners and front corners, a backrest that extends upward from the seat at an angle having sides. The outdoor bench may include rear legs positioned near the rear corners of the seat and front legs positioned near the front corners. The outdoor bench includes armrests that extend from the sides of the backrest to the front corners of the seat and front legs. The outdoor bench includes an auxiliary leg coupled to the seat between the rear legs. The auxiliary leg may be permanently coupled to the seat by a snap-fit to a coupling aperture of the seat. This outdoor bench offers comfortable seating for two individuals and enhances transportation and shipment of the outdoor bench by saving space due the stacking capabilities of the benches with the auxiliary leg removed.

3 Claims, 11 Drawing Sheets

(56) References Cited

U.S. PATENT DOCUMENTS 4,174,866 A * 11/1979 Rhyan ..... A61G 5/1094 297/188.18 X
4,341,419 A * 7/1982 Sebel ..... A47C 1/124 297/239 X
4,639,042 A * 1/1987 Lange ..... A47C 7/405 297/239
4,728,147 A * 3/1988 Dutton ..... A47C 7/62 297/188.18 X
4,906,046 A * 3/1990 Kleinklaus ..... A47C 7/407 297/239
5,382,080 A * 1/1995 Gamberini ..... A47C 3/04 297/440.1 X
5,649,737 A * 7/1997 Behnke ..... A47C 7/70 297/188.18 X
5,688,024 A * 11/1997 Arizpe-Gilmore ... A01M 31/02 297/440.1
5,938,287 A * 8/1999 Donnelly ..... A47C 7/54 297/446.1 X
5,954,396 A * 9/1999 Kemnitzer ..... A47C 3/04 297/248
5,967,345 A * 10/1999 Subotin ..... A47C 7/70 297/188.18 X
6,062,640 A * 5/2000 Stahl ..... A47C 7/70 297/188.18 X
6,338,528 B1 * 1/2002 Lohness ..... A47C 1/124 297/239 X
6,406,094 B2 * 6/2002 Lohness ..... A47C 1/124 297/248 X
6,866,338 B2 * 3/2005 Mendenhall ..... A47C 7/002 297/239
7,401,854 B2 * 7/2008 Adams ..... A47C 3/04 297/239 X
8,333,430 B2 * 12/2012 Adams ..... A47C 7/462 297/239 X
8,474,916 B2 * 7/2013 Smith ..... A47C 3/18 297/440.1
8,528,979 B2 * 9/2013 College ..... F16B 12/26 297/440.13 X
9,289,069 B2 * 3/2016 Adams ..... A47C 7/029
9,504,329 B2 * 11/2016 Adams, IV ..... A47C 3/12
9,532,654 B1 * 1/2017 Adams, IV ..... A47C 7/68
9,675,176 B2 * 6/2017 Adams, IV ..... B29C 45/16
9,872,569 B2 * 1/2018 Hasson ..... A47C 7/622
11,064,810 B2 * 7/2021 Snir ..... A47C 7/622
12,004,661 B2 * 6/2024 Reinhart ..... A47C 1/00
12,082,710 B2 * 9/2024 Reinhart ..... A47C 3/04
12,161,229 B2 * 12/2024 Reinhart ..... A47C 3/04
12,171,341 B2 * 12/2024 Meccola ..... A47C 17/86
12,285,110 B2 * 4/2025 Reinhart ..... A47C 3/04
2004/0051365 A1 * 3/2004 Darst ..... A47K 3/122 297/440.1
2008/0116727 A1 * 5/2008 Cox ..... A47C 3/04 297/239
2015/0223609 A1 * 8/2015 Prokofiev ..... A47C 7/68 297/188.14
2015/0327675 A1 * 11/2015 Fenner ..... A47B 83/02 297/188.18 X
2016/0220027 A1 * 8/2016 Milde ..... A47C 1/14
2018/0289160 A1 * 10/2018 McFall ..... A47C 1/14
2022/0330701 A1 * 10/2022 Goodworth ..... A47C 3/04
2024/0285081 A1 * 8/2024 Reinhart ..... A47C 7/002
2025/0031851 A1 * 1/2025 Reinhart ..... A47C 3/04

FOREIGN PATENT DOCUMENTS

CN 104433422 A * 3/2015 ..... A47C 3/04
DE 19633069 A1 * 2/1998 ..... A47C 1/124
DE 202007011802 U1 * 10/2007 ..... A47C 5/06
DE 102009024260 A1 * 12/2010 ..... A47C 3/04
DE 202013001028 U1 * 3/2013 ..... A47C 3/04
DE 102016012688 A1 * 4/2018 ..... A47C 1/124
DE 202024104572 U1 * 8/2024 ..... A47C 3/04
EP 2227986 A2 * 9/2010 ..... A47C 3/12
EP 3308674 A1 * 4/2018 ..... A47C 3/04
FR 3132197 A1 * 8/2023 ..... A47C 1/124
KR 102680680 B1 * 7/2024 ..... F16B 12/10

* cited by examiner

BENCH WITH REMOVABLE LEG

CROSS-REFERENCE TO RELATED APPLICATIONS

This application claims the benefit of U.S. Provisional Application No. 63/431,102 filed on Dec. 8, 2022. The entire disclosure of the above application is incorporated herein by reference.

FIELD

The present technology relates to benches and, more particularly, an outdoor bench for two persons.

INTRODUCTION

This section provides background information related to the present disclosure which is not necessarily prior art.

Adirondack-style chairs are a larger type of chair and are very popular. For many years, these chairs were made of wood with the pieces of the chair nailed, glued, bolted, or screwed together to form a single unit. The Adirondack-style chair typically has a straight back formed by multiple wooden panels that extend from a seat at an angle. Most wooden Adirondack-style chairs are not foldable. They are heavy and also very difficult to stack.

More recently, some Adirondack-style chairs are made of plastic. These chairs are molded to look like the wooden Adirondack chairs. Such molded plastic chairs are lighter and may be more weather resistant than their wooden predecessors. Further, the molded plastic chairs may be stored more efficiently since the molded plastic chairs may often be stacked on top of one another.

Outdoor benches for multiple persons, including benches in the Adirondack style, typically involve a design having a seat and a backrest. These benches often lack armrests, which can provide additional comfort and support for the users. Additionally, the absence of armrests can make it difficult for users to maintain a comfortable sitting position for extended periods of time. Furthermore, the lack of additional support legs in longer, multiple person benches can result in instability, especially when the bench is placed on uneven surfaces or subjected to external forces. Outdoor benches that accommodate more than one person may be larger in size, heavier, and difficult to transport and/or ship.

Accordingly, there is a need for a plastic Adirondack-style bench that can accommodate more than one person and is also easy to transport and stack.

SUMMARY

In concordance with the instant disclosure, a plastic Adirondack-style bench that can accommodate more than one person and is also easy to transport and stack, has surprisingly been discovered.

The present technology includes articles of manufacture that relate to an outdoor bench. In certain embodiments, an outdoor bench for two persons is provided. The outdoor bench may include a seat configured for seating the two persons and having a pair of rear corners and a pair of front corners. A backrest may extend upward from the seat at an angle and have a pair of sides. A pair of rear legs may extend downward from the seat where each rear leg may be positioned proximate to one of the rear corners of the seat. A pair of front legs may extend downward from the seat where each front leg may be positioned proximate to one of the front corners of the seat. A pair of armrests may be provided, where each armrest may extend from one of the sides of the backrest to at least one of the front corners of the seat and one of the front legs. An auxiliary leg may be included that is configured to be coupled to the seat at a position between the rear legs and extend downward from the seat. The auxiliary leg may be de-coupled from the seat to allow the outdoor bench to be stacked with another outdoor bench. Alternatively, the auxiliary leg may be configured to be permanently coupled to the seat. The auxiliary leg may enhance shipping and transportation of the outdoor bench.

In certain embodiments, a method of using an outdoor bench is provided. The method may include steps of providing an outdoor bench for two persons as described herein, as well as a step of coupling the auxiliary leg to the seat. In some embodiments, the method may include a step of de-coupling the auxiliary leg to the seat.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
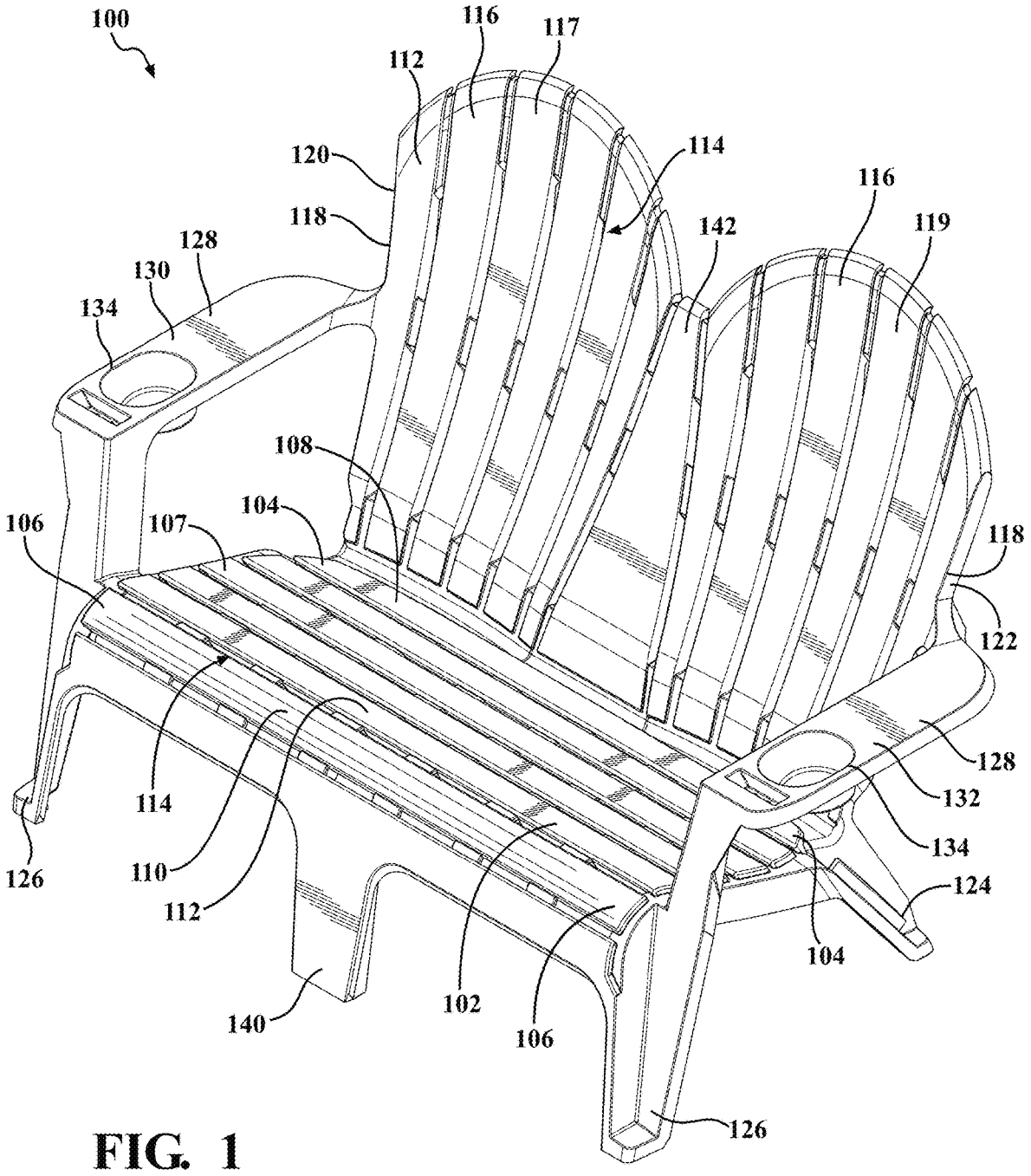
FIG. 1 is a top perspective view of an outdoor bench for two persons, according to an embodiment of the present disclosure.
Figure 2:
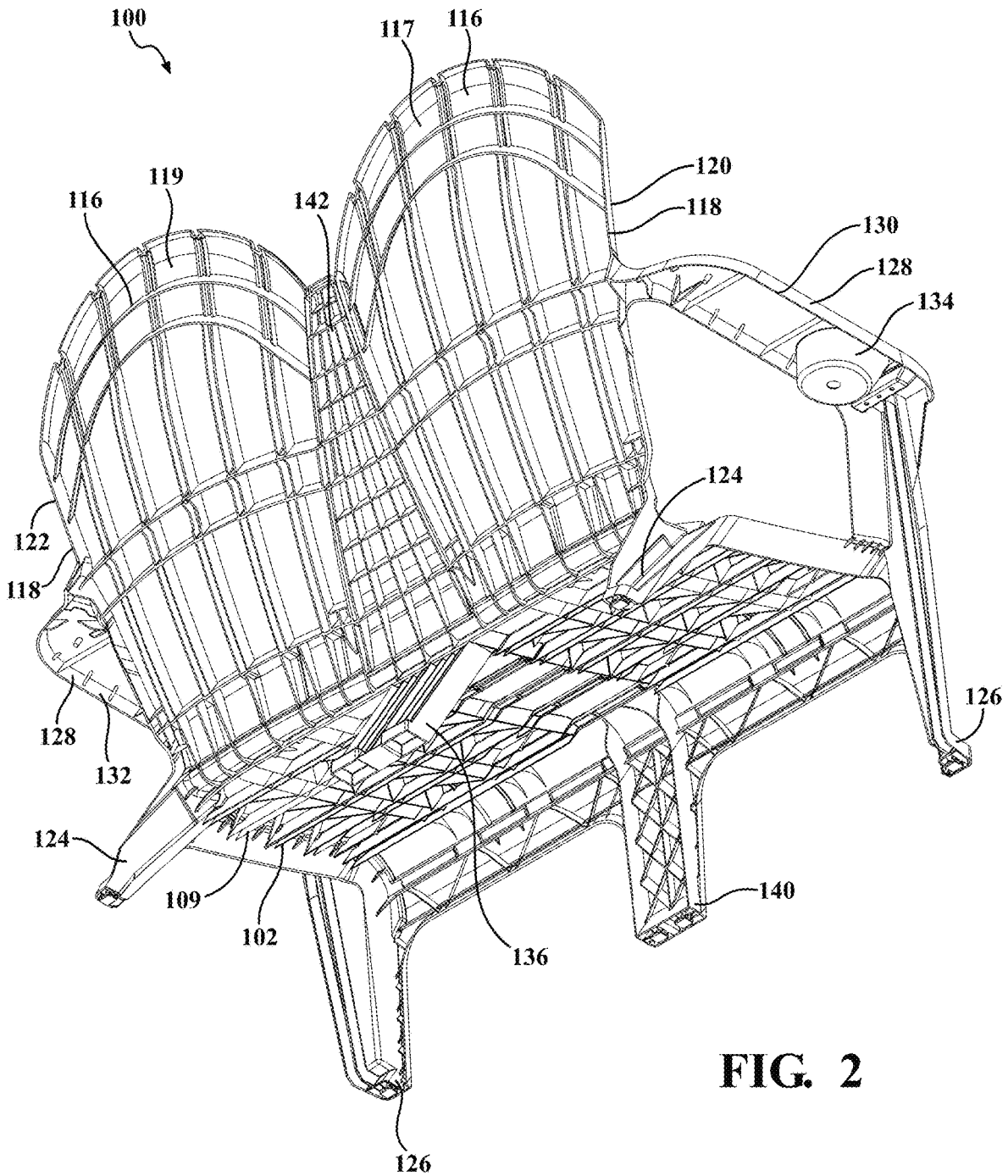
FIG. 2 is a bottom perspective view of the outdoor bench for two persons shown in FIG. 1.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise stated in this disclosure, the phrase "permanently coupled" may be interpreted to mean inseparable without damaging one or more of the coupled components. For example, two components may be permanently coupled by having a detent of one component received within an aperture of the other component, where decoupling of the two components would necessitate shearing or fracturing all or a portion of the detent received within the aperture.

The present technology relates to an outdoor bench 100, shown generally in the accompanying FIGS. 1-12. Advantageously, the outdoor bench 100 may accommodate more than one person and conveniently includes an auxiliary leg 136 that is de-coupled from the outdoor bench 100 to allow the outdoor bench 100 to be stacked with another outdoor bench 100 in order to enhance space for shipping and transportation of the outdoor bench 100. Ways of using the outdoor bench 100 are also provided.

An embodiment of the outdoor bench 100 in accordance with the present disclosure is shown in FIGS. 1-12. The outdoor bench 100 may include a seat 102, a backrest 116, a pair of rear legs 124, a pair of front legs 126, a pair of armrests 128, and the auxiliary leg 136. The outdoor bench 100 may be configured for seating of two persons.

The seat 102 may include the following aspects. The seat 102 may include a pair of rear corners 104 and a pair of front corners 106. The seat 102 may be configured for seating the two persons and may also be reclined toward the backrest 116. The seat 102 may be substantially flat and further include a curved front edge running between the pair of front corners 106. The seat 102, as well as the backrest 116, may each further include a plurality of panels 112. As a non-limiting example, the panels 112 of the seat 102 may be configured to look like slats or planks constructed to form an Adirondack-style chair. Further, multiple panels 112 may be configured to look like slats, in a certain embodiment. Each of the panels 112 of the seat 102 may be horizontally disposed relative to another to define the seat 102 and form an interrupted surface 114. The seat 102 may also include a top side 107, a bottom side 109, a first end 108, and a second end 110. The bottom side 109 of the seat 102 may include a coupling aperture 103 configured to receive the auxiliary leg 136, as further explained herein. The bottom side 109 may include a plurality of braces to provide additional strength and support for the seat 102, where such braces can be disposed in various numbers, shapes, and formations, including X-formations, V-formations, or combinations thereof. Advantageously, the orientation of the braces can enhance the structural integrity of the outdoor bench 100. One of ordinary skill in the art may select a suitable number and orientation of the braces within the scope of the present disclosure. Additionally, the first end 108 may be disposed on a first plane (A) proximate the pair of rear corners 104 of the seat 102 and the second end 110 may be disposed on a second plane (B) proximate the pair of front corners 106 of the seat 102. The second plane (B) may be substantially parallel with the first plane (A) and the seat 102 may extend at a downward angle from the second plane (B) to the first plane (A). In a certain embodiment, the second end 110 may be disposed at a higher position than the first end 108 of the seat 102, which also defines the reclined nature of the seat 102.

The backrest 116 may include the following aspects. The backrest 116 may extend upward from the seat 102 at an angle. The backrest may include curves to accommodate the natural resting position of each person seated on outdoor bench 100. The backrest 116 may be relatively flat but still extend upward at an angle from the seat 102. The backrest 116 may also have a pair of sides 118. The backrest 116 may further include a first side 120 and a second side 122. The first side 120 may be connected to one of the pair of armrests 128 at a central position. The second side 122 may be connected to the other of the pair of armrests 128 at a central position. The backrest 116 may be connected to the entirety of the length of the first end 108 of the seat 102. The backrest 116 may also be reclined relative to the seat 102. Advantageously, this allows for a comfortable resting position for the user due to the configuration of the reclined nature of the seat 102 as well. As stated herein, the backrest 116 may also include the plurality of panels 112. As a non-limiting example, the panels 112 of the backrest 116 may be made to look like slats or planks constructed to form an Adirondack-style chair. Further, multiple panels 112 may be configured to look like slats, in a certain embodiment. Each of the panels 112 of the backrest 116 may be vertically disposed relative to another to define the backrest 116 and also form the interrupted surface 114. The backrest 116 may also include a first backrest portion 117 and a second backrest portion 119, each configured to support the back of each person seated on the outdoor bench 100.

Figure 3:
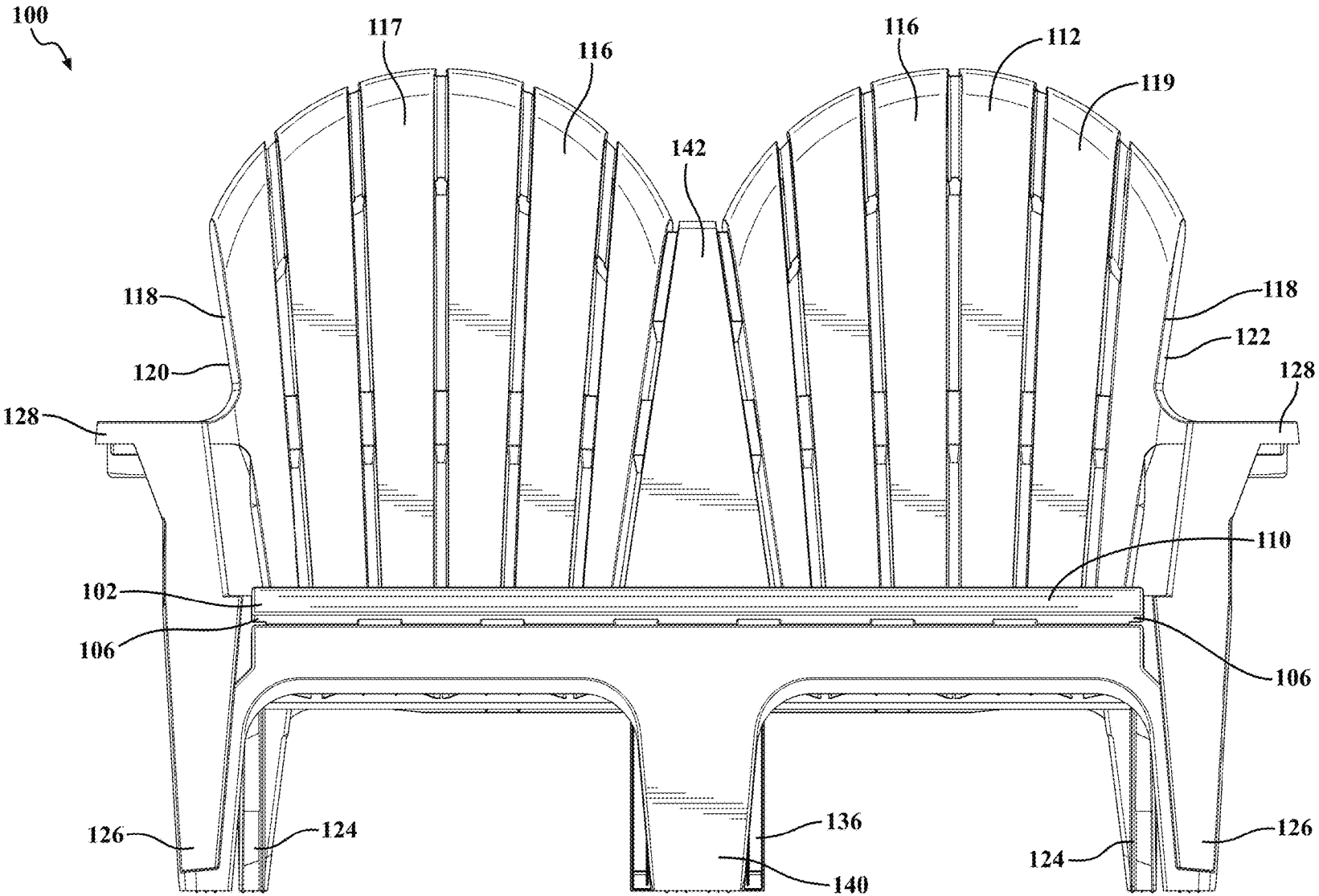
FIG. 3 is a front elevational view of the outdoor bench for two persons shown in FIG. 1.
Figure 4:
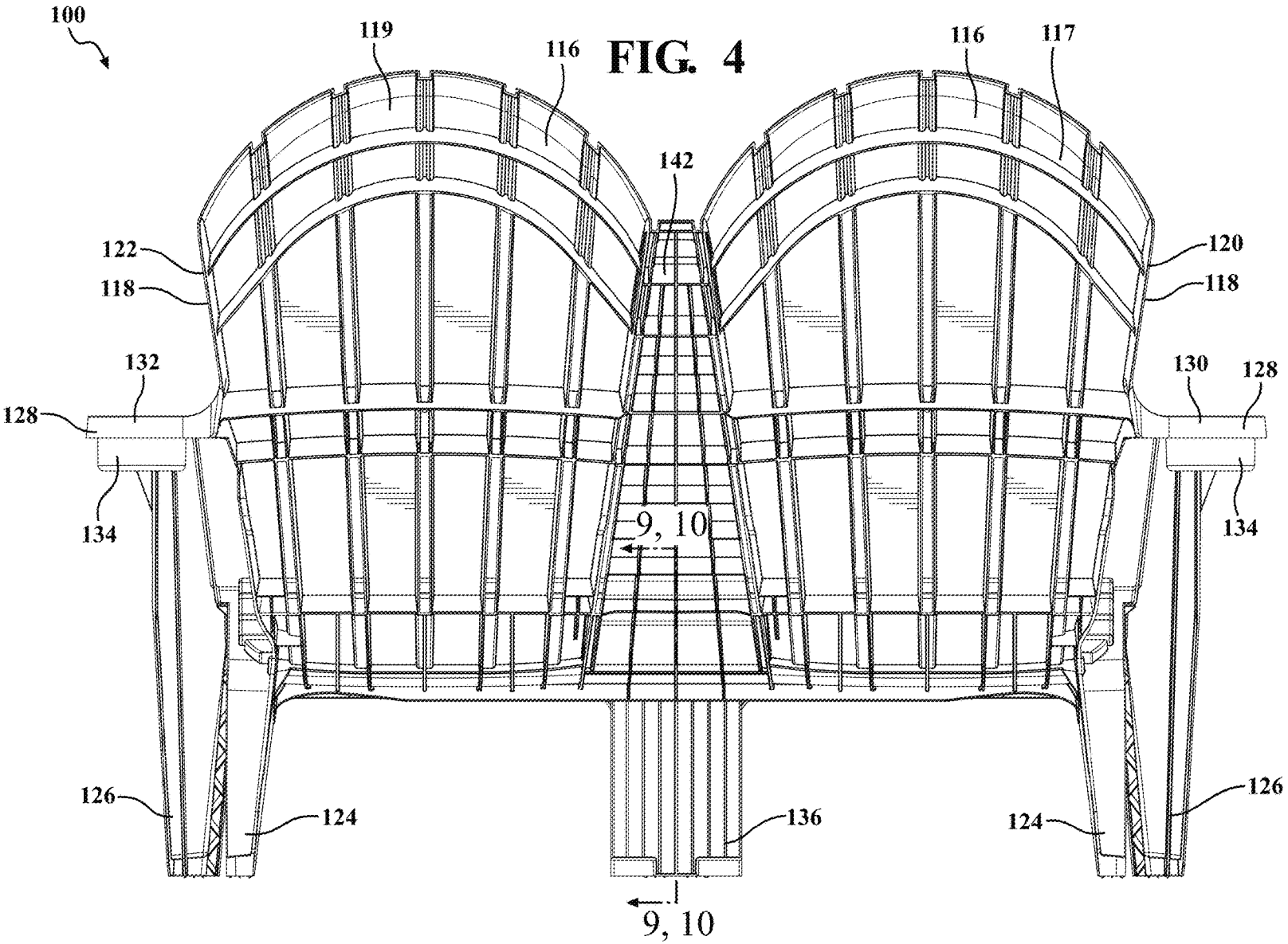
FIG. 4 is a rear elevational view of the outdoor bench for two persons shown in FIG. 1.
Figure 5:
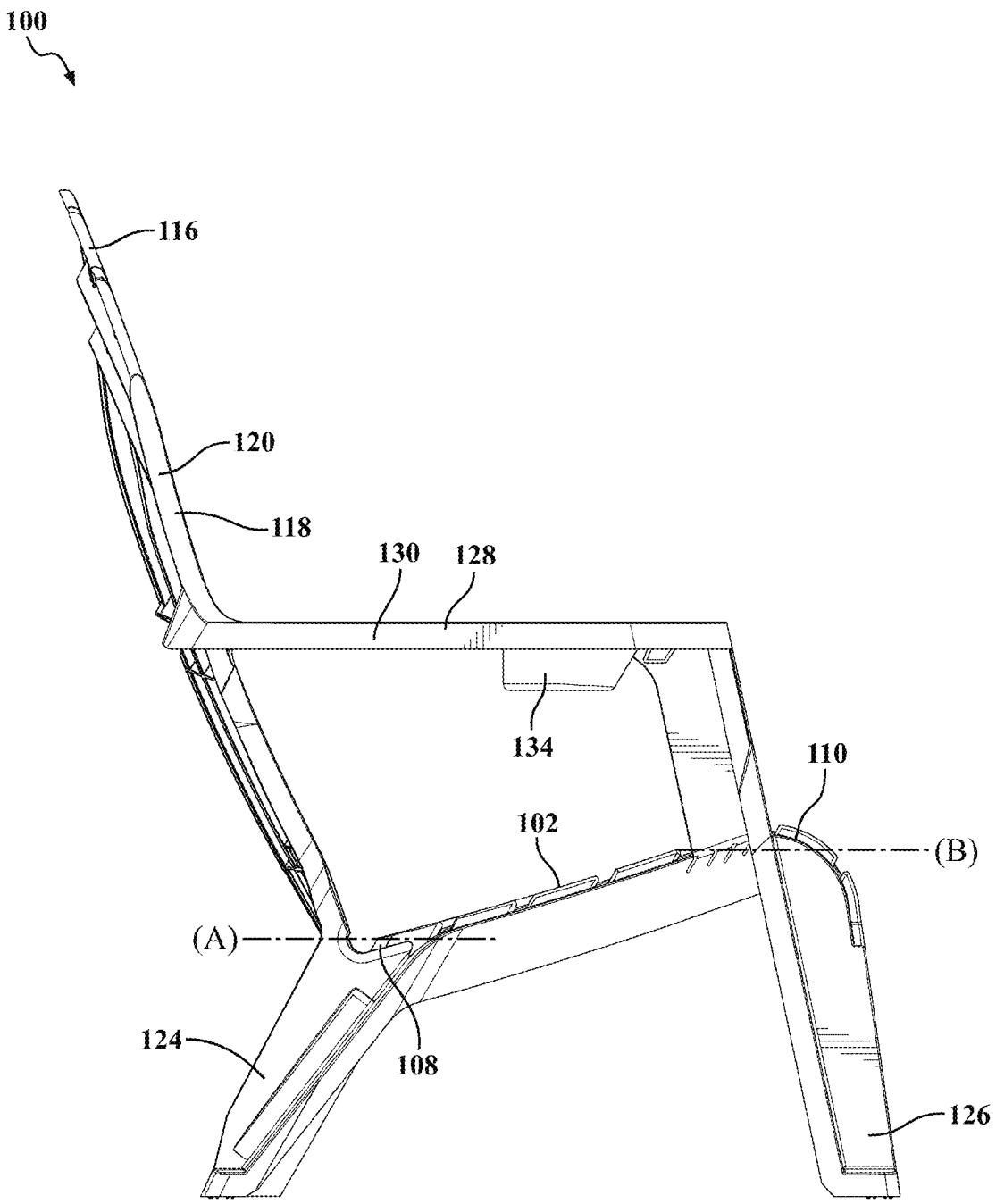
FIG. 5 is left-side elevational view of the outdoor bench for two persons shown in FIG. 1.
Figure 6:
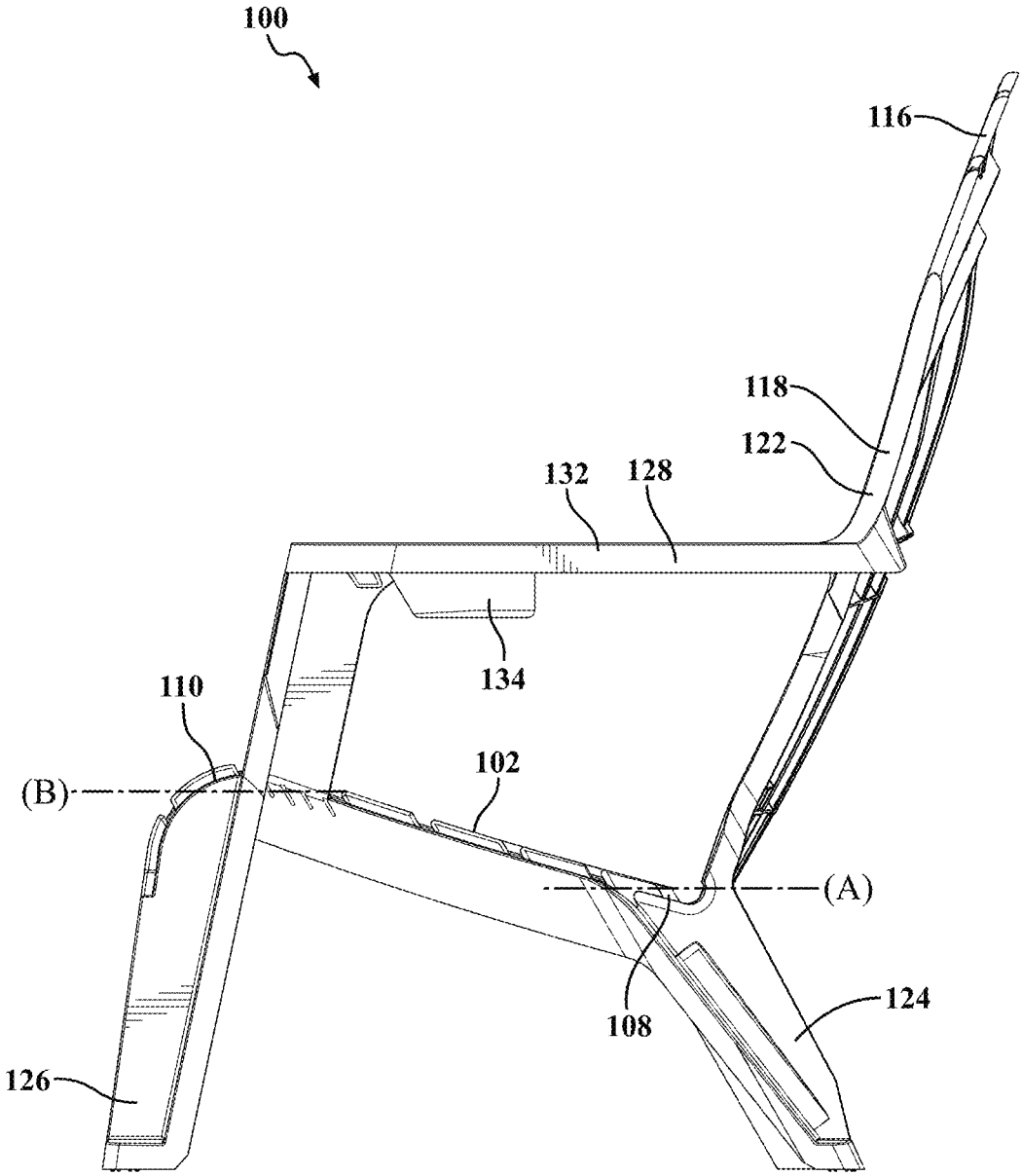
FIG. 6 is a right-side elevational view of the outdoor bench for two persons shown in FIG. 1.
Figure 7:
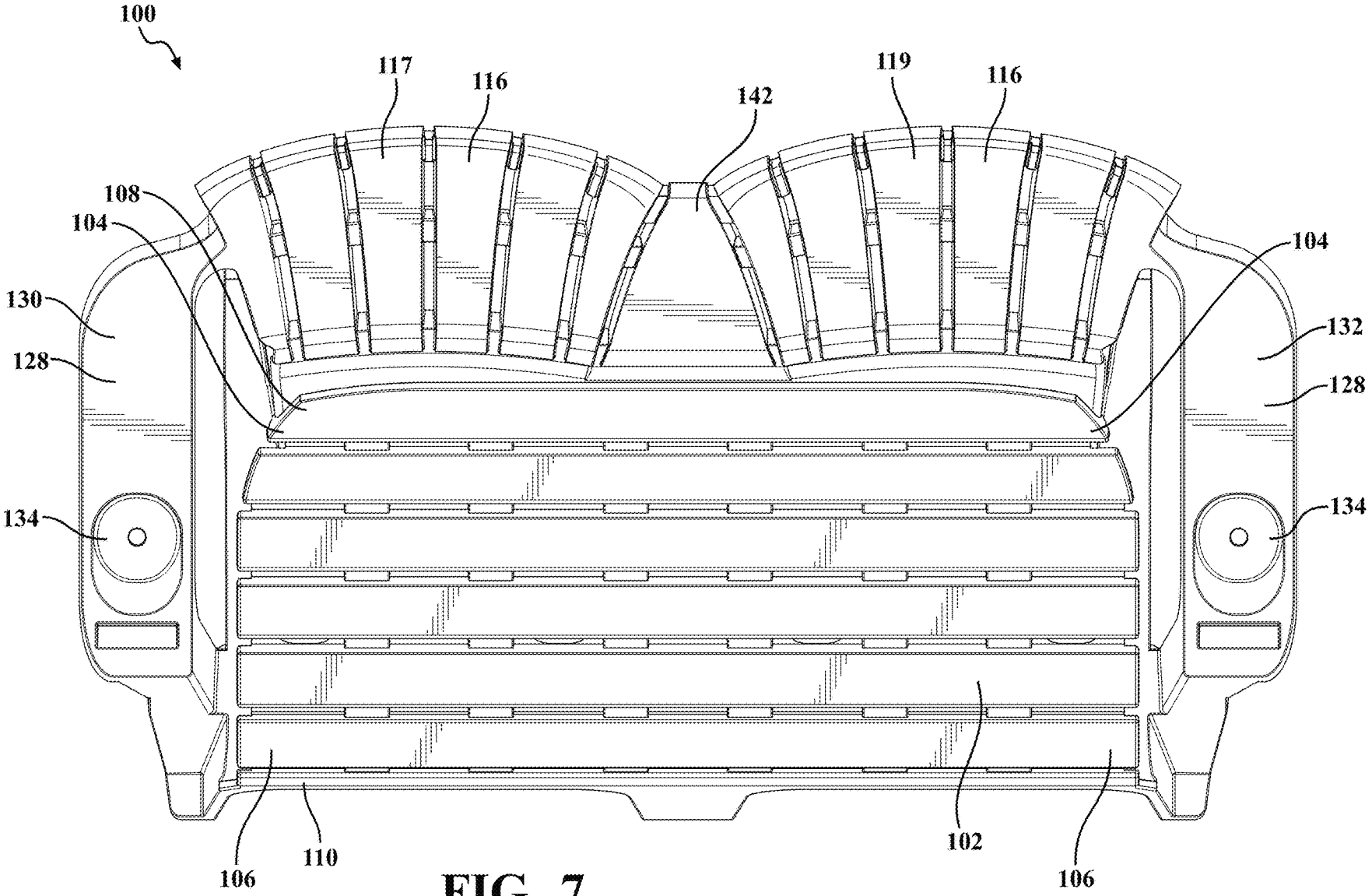
FIG. 7 is a top plan view of the outdoor bench for two persons shown in FIG. 1.
Figure 8:
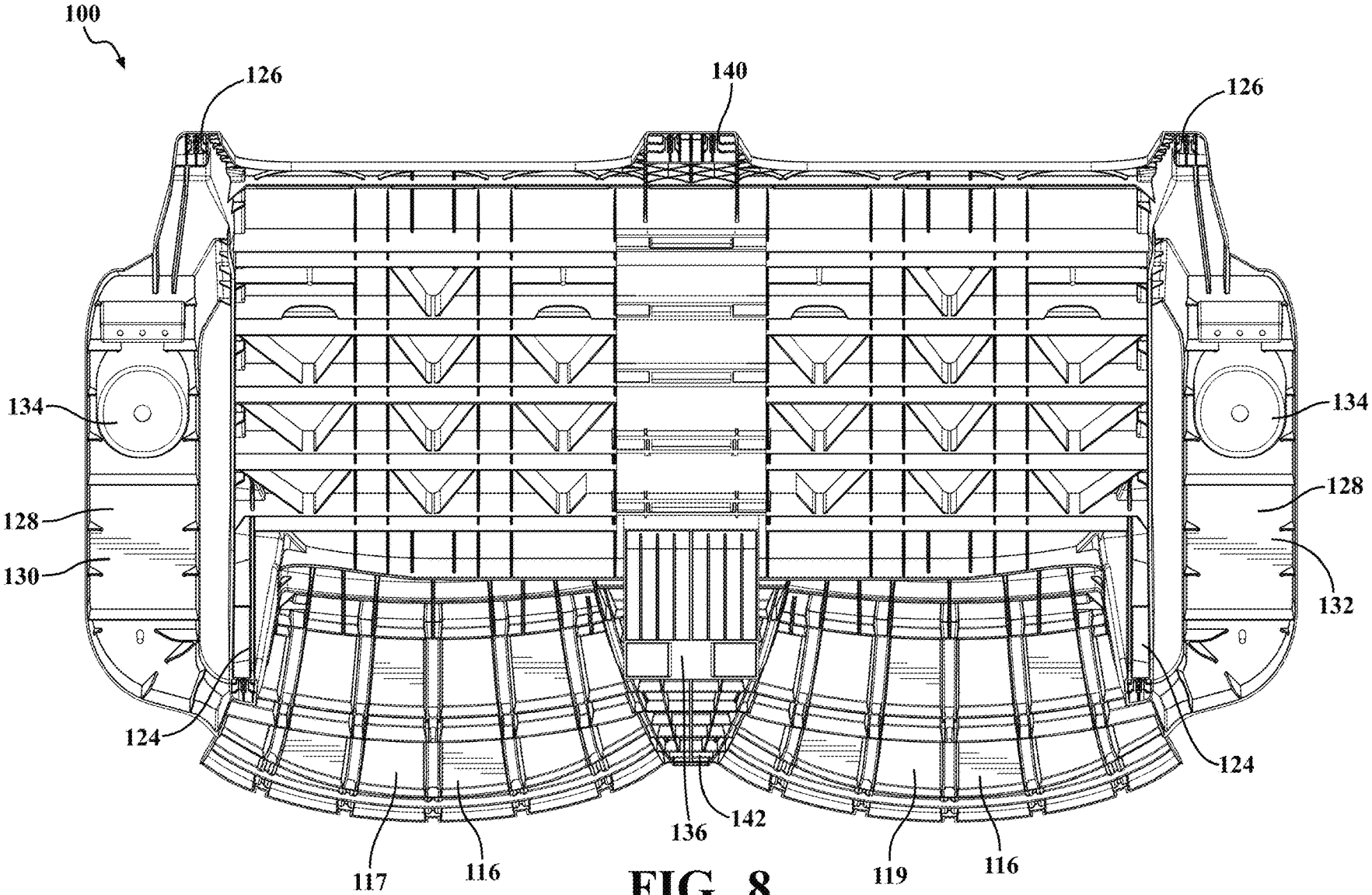
FIG. 8 is a bottom plan view of the outdoor bench for two persons shown in FIG. 1.
Figure 9:
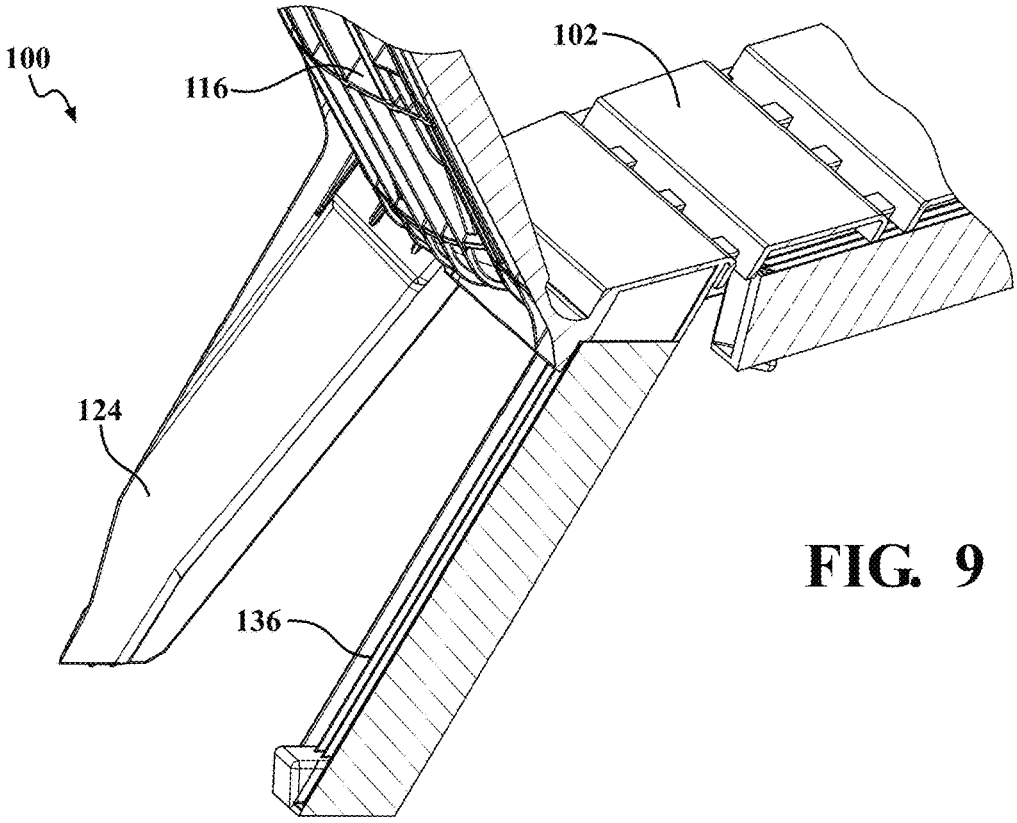
FIG. 9 is cross-sectional perspective view showing a portion of the auxiliary leg of the outdoor bench coupled to a portion of the seat taken at line 9-9 in FIG. 4.
Figure 10:
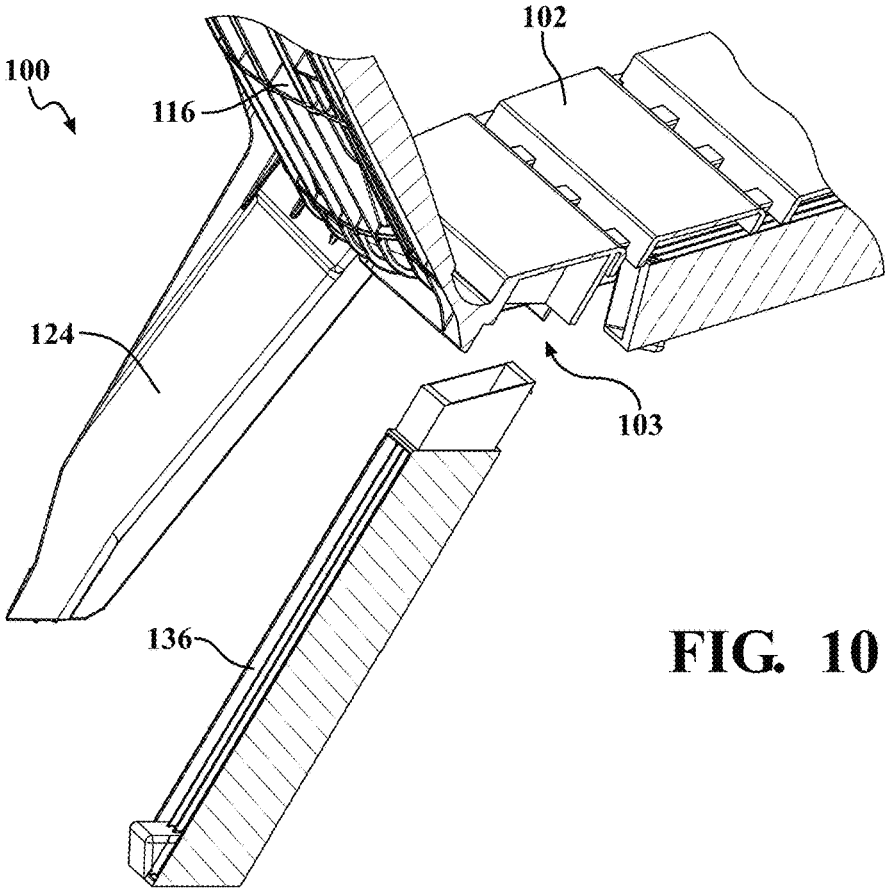
FIG. 10 is a cross-sectional perspective view showing the portion of the auxiliary leg of the outdoor bench de-coupled from the portion of the seat taken at line 10-10 in FIG. 4.
Figure 11:
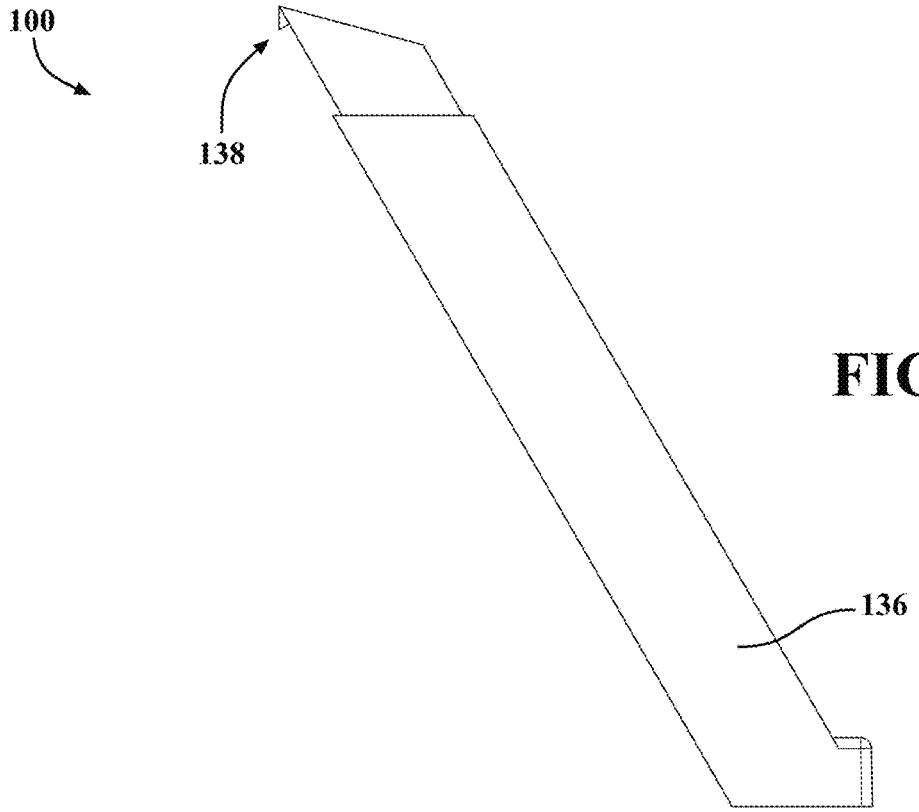
FIG. 11 is a side elevational view of the auxiliary leg of the outdoor bench.
Figure 12:
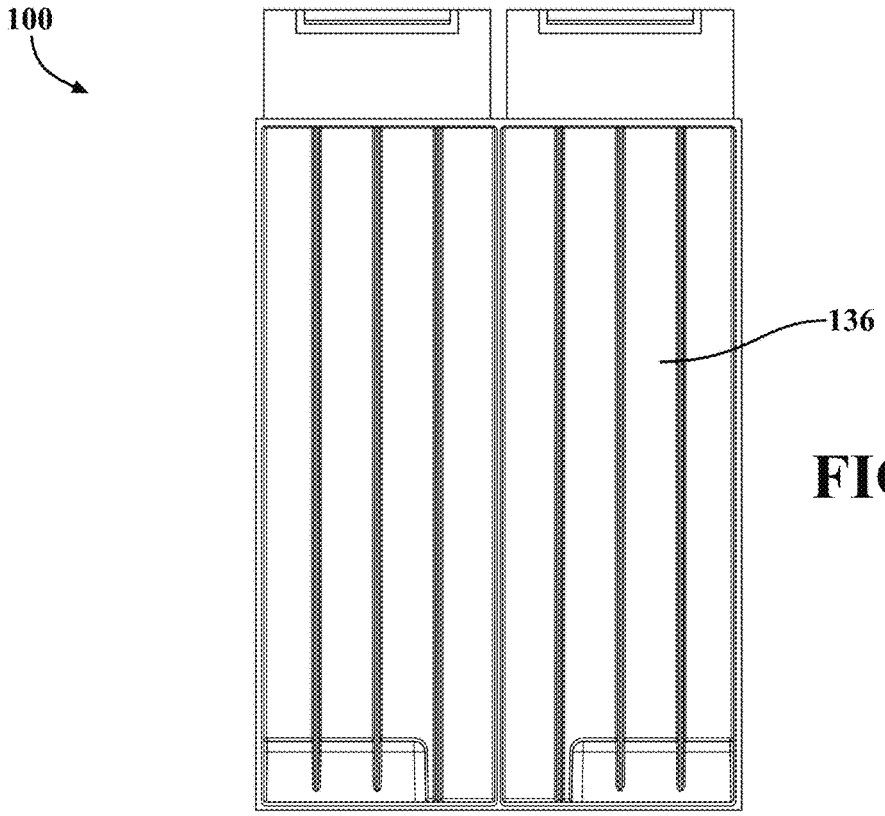
FIG. 12 is a rear elevational view of the auxiliary leg of the outdoor bench.

With continued reference to the backrest 116, as shown generally in FIGS. 1-12, the backrest 116 may include a central panel 142. The central panel 142 may be disposed between the first backrest portion 117 and the second backrest portion 119. The central panel 142 may also be triangular in shape, as shown. The central panel 142 may be configured to enhance the overall stability and strength of the first backrest portion 117 and the second backrest portion 119 as they are connected. The central panel 142 may include a relatively flat surface on one side, as shown in FIGS. 1 and 3. Additionally, the central panel 142 may include a tapered width. One of ordinary skill in the art may select suitable dimensions for the central panel 142 within the scope of the present disclosure.

The pair of rear legs 124 may include the following aspects. The pair of rear legs 124 may extend downward from the seat 102. Each of the rear legs 124 may be positioned proximate to one of the rear corners 104 of the seat 102. In another embodiment, each of the rear legs 124 may be connected to each of the rear corners 104 of the seat 102. The pair of rear legs 124 may also extend downward from the seat 102 at an angle. Advantageously, the positioning of the pair of rear legs 124 provides support for the weight and capacity of two persons on the outdoor bench 100. One of ordinary skill in the art may select a suitable configuration of the pair of rear legs 124 within the scope of the present disclosure.

The pair of front legs 126 may include the following aspects. The pair of front legs 126 may extend downward from the seat 102. Each of the front legs 126 may be positioned proximate to one of the front corners 106 of the seat 102. Each of the front legs 126 may be connected to one of the front corners 106 of the seat 102. The pair of front legs 126 may also extend downward from the seat 102 at an angle. One of ordinary skill in the art may select a suitable configuration for the pair of front legs 126 within the scope of the present disclosure. Further, one of the front legs 126 may be disposed opposite of one of the rear legs 124.

The pair of armrests 128 may include the following aspects. Each armrest of the pair of armrests 128 may extend from one of the sides 118 of the backrest 116 to at least one of the front corners 106 of the seat 102 and one of the front legs 126. The pair of armrests 128 may include a first armrest 130 and a second armrest 132. In another embodiment, the armrests 128 may extend from one of the sides 118 of the backrest 116 to both the one of the front corners 106 of the seat 102 and one of the front legs 126. One of ordinary skill in the art may select a suitable configuration for the armrests 128 within the scope of the present disclosure. The armrests 128 may also be centrally disposed and connected to the sides 118 of the backrest 116. Each of the armrests 128 also includes a cupholder 134. The cupholder 134 may be configured to receive a cup or beverage as it includes a circular opening with a hollow body that protrudes outward below the armrests 128. The cupholder 134 may be designed in different shapes. One of ordinary skill in the art may select a suitable cupholder 134 within the scope of the present disclosure. In another embodiment, the pair of armrests 128 may not include a cupholder 134.

The auxiliary leg 136 may include the following aspects. The auxiliary leg 136 may include a detent 138 configured to be received and inserted into the coupling aperture 103 of the seat 102 of the outdoor bench 100. The detent 138 and the coupling aperture 103 may cooperate via a snap fit to couple the auxiliary leg 136 to the bottom side 109 of the seat 102. One of ordinary skill in the art may select other suitable means and method to couple the auxiliary leg 136 to the seat 102, as desired. The auxiliary leg 136 may be configured to be coupled to the seat 102 at a position between the pair of rear legs 124 and extend downward from the seat 102. In another embodiment, the auxiliary leg 136 may be centrally disposed between the rear legs 124. One of ordinary skill in the art may select a suitable location to dispose the auxiliary leg 136 within the scope of the present disclosure. The auxiliary leg 136 may also be permanently coupled to the seat 102 at a position between the pair of rear legs 124. In the alternative, the auxiliary leg 136 may be removably coupled to the seat 102 at a position between the pair of rear legs 124. Advantageously, the outdoor bench 100 may be provided with the auxiliary leg 136 de-coupled from the seat 102 to save space during shipment and transportation of the outdoor bench 100. The auxiliary leg 136 may be easily coupled to the seat 102. Desirably, removal of the auxiliary leg 136 allows the outdoor bench 100 to be stacked with another outdoor bench 100 to save space.

The outdoor bench 100 may also include the following aspects. The outdoor bench may further include a support leg 140. The support leg 140 may provide additional support and stability to the pair of front legs 126 of the outdoor bench 100. The support leg 140 may be centrally disposed between the pair of front legs 126. The support leg 140 may also be connected to the seat 102 and may extend downward from the seat 102 at an angle. The support leg 140 may include a relatively flat surface on one side. Further, the support leg 140 may be disposed relatively opposite the auxiliary leg 136. The support leg 140 may be permanently coupled to the outdoor bench 100 and may be injection molded as a single component. In another embodiment, the support leg 140 may be removably coupled to the seat 102. One of ordinary skill in the art may select a suitable configuration for the support leg 140 within the scope of the present disclosure.

Additionally, the outdoor bench 100 may be injection molded. Advantageously, the outdoor bench 100 may be injection molded as a unitary structure. In another embodiment, the outdoor bench 100 may be injection molded into separate components that may be configured to be coupled together to form the outdoor bench 100. More particularly, the entirety of the outdoor bench 100 may be injection molded into a single unitary piece with the exception of the auxiliary leg 136 where the auxiliary leg 136 may be separately formed by injection molding and coupled to the seat 102 of the outdoor bench 100. One of ordinary skill in the art may select a suitable configuration to manufacture the outdoor bench 100 within the scope of the present disclosure. Additionally, the seat 102 and the backrest 116 may be formed so that they do not include an aperture sized to permit the auxiliary leg 136 to pass therethrough. For example, one outdoor bench 100 having a coupled auxiliary leg 136 cannot be stacked and nested atop another outdoor bench 100, as there is no aperture for the coupled auxiliary leg 136 to pass through the another outdoor bench and hence no way for respective seats 102 and backrests 116 to stack adjacent to each other.

In another embodiment, a stack of a plurality of outdoor benches is provided (not shown). In this embodiment, each outdoor bench comprises the outdoor bench 100 as described herein. The auxiliary leg 136 of each of outdoor bench 100 may be de-coupled to allow the stacking of the outdoor benches 100. In this way, respective seats 102 and backrests 116 of the outdoor benches 100 may stack adjacent to each other.

Figure 13:
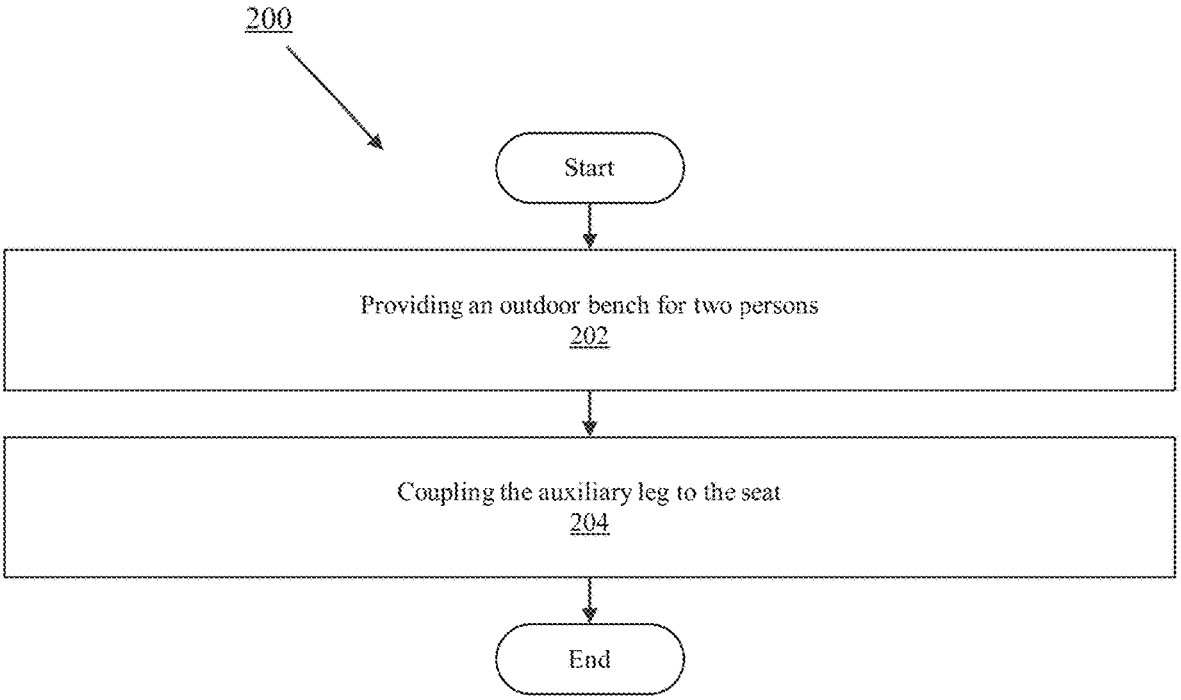
FIG. 13 is a flowchart illustrating a method of using the outdoor bench, according to an embodiment of the present disclosure.

FIG. 13 is a flowchart that describes a method 200 of using an outdoor bench 100, according to an embodiment of the present disclosure. At step 202, the method 200 may include providing an outdoor bench for two persons as described herein. At step 204, the method 200 may include coupling the auxiliary leg 136 to the seat 102. In some embodiments, the method 200 may include a step 206 of de-coupling the auxiliary leg 136 to the seat 102.

Advantageously, the outdoor bench 100 may accommodate two persons rather than a single person. The outdoor bench 100 is also reclined to provide a comfortable resting position for the two persons. Desirably, the auxiliary leg 136 is removably coupled to the outdoor bench 100 to allow the outdoor bench 100 to be stacked with another outdoor bench 100. Advantageously, the outdoor bench 100 may be packaged in a smaller volume of space and this enhances shipment and transportation of the outdoor bench 100 in bulk.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. An outdoor bench for two persons, comprising:

a seat configured for seating the two persons, the seat having a pair of rear corners and a pair of front corners;

a backrest extending upward from the seat at an angle, the backrest having a pair of sides;

a pair of rear legs extending downward from the seat, each rear leg positioned proximate to one of the rear corners of the seat;

a pair of front legs extending downward from the seat, each front leg positioned proximate to one of the front corners of the seat;

a pair of armrests, each armrest extending from one of the sides of the backrest to at least one of the front corners of the seat and one of the front legs; and an auxiliary leg configured to be coupled to the seat at a position between the rear legs and extend downward from the seat, wherein:

the seat is reclined toward the backrest, the backrest is reclined relative to the seat, the pair of armrests includes a cupholder, each armrest extends from one of the sides of the backrest to one of the front corners of the seat and one of the front legs, the auxiliary leg is configured to be permanently coupled to the seat at the position between the rear legs, the auxiliary leg further includes a detent configured to be inserted into a coupling aperture in the seat of the outdoor bench, the auxiliary leg is configured to be removably coupled to the seat at the position between the rear legs, the seat and the backrest each include a plurality of panels, the panels of the plurality of panels of the seat are horizontally disposed adjacent one another to define the seat, the panels of the plurality of panels of the backrest are vertically disposed adjacent one another to define the backrest, the plurality of panels of the seat and the backrest each form an interrupted surface, the seat includes a first end disposed on a first plane proximate the pair of rear corners and a second end disposed on a second plane proximate the pair of front corners, the second plane is substantially parallel with the first plane, and the seat extends at a downward angle from the second plane to the first plane.

2. A method of using a plurality of outdoor benches for two persons, each outdoor bench including the outdoor bench of claim 1, the method comprising:

removing one of the outdoor benches from a stack of the plurality of outdoor benches; and coupling the auxiliary leg to the seat of the removed outdoor bench.

3. A method of using a plurality of outdoor benches for two persons, each outdoor bench including the outdoor bench of claim 1, the method comprising:

decoupling the auxiliary leg from the seat of one of the outdoor benches; and stacking the outdoor bench having the decoupled auxiliary leg atop another of the outdoor benches.

* * * * *